US010820647B2

(12) United States Patent
Grossbard et al.

(10) Patent No.: US 10,820,647 B2
(45) Date of Patent: Nov. 3, 2020

(54) WEARABLE HAIRPIECE FOR PARTIAL HEAD COVERING

(71) Applicants: Gavriel Grossbard, Southfield, MI (US); Milaine Grossbard, Southfield, MI (US)

(72) Inventors: Gavriel Grossbard, Southfield, MI (US); Milaine Grossbard, Southfield, MI (US)

( * ) Notice: Subject to any disclaimer, the term of this patent is extended or adjusted under 35 U.S.C. 154(b) by 486 days.

(21) Appl. No.: 15/787,869

(22) Filed: Oct. 19, 2017

(65) Prior Publication Data

US 2018/0110277 A1 Apr. 26, 2018

Related U.S. Application Data

(60) Provisional application No. 62/410,635, filed on Oct. 20, 2016.

(51) Int. Cl.
*A41G 5/00* (2006.01)

(52) U.S. Cl.
CPC ..... *A41G 5/0073* (2013.01)

(58) Field of Classification Search
CPC ..... A41G 5/0073; A41G 5/0093
See application file for complete search history.

(56) References Cited

U.S. PATENT DOCUMENTS 3,295,536 A * 1/1967 Shaw ..... A41G 5/0093 132/53
5,806,535 A * 9/1998 Becker ..... A41G 3/0016 132/53
6,766,805 B1 * 7/2004 Cupp ..... A41G 5/0073 132/273
7,784,472 B2 8/2010 Hochi
9,113,669 B1 * 8/2015 Kleinman ..... A41G 5/0073
9,138,024 B1 * 9/2015 Solomon ..... A41G 5/0073
9,930,919 B1 * 4/2018 Branker ..... A41G 5/0073
2002/0056464 A1 * 5/2002 Nakane ..... A41G 5/0093 132/53
2005/0247324 A1 11/2005 Nicot et al.
2006/0174905 A1 * 8/2006 Bias ..... A41G 5/0093 132/53

(Continued)

OTHER PUBLICATIONS

Hidden Crown Hair Extensions; https://www.hiddencrownhair.com/product/dark-brown-2/.

(Continued)

*Primary Examiner* — Nicholas D Lucchesi
(74) *Attorney, Agent, or Firm* — Young Basile Hanlon & MacFarlane, P.C.

(57) ABSTRACT

A wearable hairpiece for covering at least a portion of a head of a human user comprises a band having a stretchable size and comprised of a non-slip material, at least one hair weft coupled to at least one of a nape piece or a back side of the band, and at least one clip element coupled to the back side of the band. A first hair layer including hair added by the at least one hair weft and a second hair layer comprised of the natural hair of the human user are arranged in a flat formation allowing the first and second hair layers to collectively appear as a single layer on the head of the human user. A wearable accessory can be simultaneously used with the wearable hairpiece without the wearable accessory appearing to rest on top of the added hair.

18 Claims, 4 Drawing Sheets

(56) References Cited

U.S. PATENT DOCUMENTS

| | | | | |
|---|---|---|---|---|
| 2008/0178902 | A1* | 7/2008 | Moeszinger | A41G 5/0093 132/273 |
| 2010/0154812 | A1* | 6/2010 | Westerman Holstijn | A41G 5/0093 132/54 |
| 2011/0005544 | A1* | 1/2011 | Lane | A41G 5/0073 132/201 |
| 2012/0222692 | A1* | 9/2012 | Ray | A41G 5/0093 132/53 |
| 2015/0013710 | A1* | 1/2015 | Buzaglo | A41G 5/0093 132/201 |
| 2015/0327611 | A1* | 11/2015 | Kleinman | A41G 5/0046 132/201 |
| 2016/0143381 | A1* | 5/2016 | Helmers | A41G 5/0073 132/53 |
| 2017/0208884 | A1* | 7/2017 | Alex | A41G 5/0073 |
| 2017/0208885 | A1* | 7/2017 | Alex | A41G 5/0073 |
| 2017/0215506 | A1* | 8/2017 | Sim | A41G 3/0066 |
| 2017/0295878 | A1* | 10/2017 | Cobb | A41G 5/0093 |
| 2018/0228236 | A1* | 8/2018 | Curbeon | A41G 5/0073 |
| 2019/0104793 | A1* | 4/2019 | Young | A41G 5/004 |
| 2019/0281912 | A1* | 9/2019 | Mayer | A41G 5/0053 |
| 2020/0060369 | A1* | 2/2020 | Fillerup | A41G 5/0073 |
| 2020/0093210 | A1* | 3/2020 | Bernstein | A41G 5/0073 |

OTHER PUBLICATIONS

Riviera Headband Fall; http://savvysheitels.com/zcart/custom-european-c-52_63/riviera-headband-fall-p-765.html.
Halo-European Bandanna Fall; http://savvysheitels.com/zcart/band-falls-hat-falls-c-57_17/halo-european-bandanna-fall-p-687.html.

* cited by examiner

WEARABLE HAIRPIECE FOR PARTIAL HEAD COVERING

CROSS REFERENCE TO RELATED APPLICATION(S)

This disclosure claims the benefit of U.S. Provisional Application No. 62/410,635, filed Oct. 20, 2016, the disclosure of which is hereby incorporated by reference in its entirety.

TECHNICAL FIELD

This disclosure relates in general to a wearable hairpiece for partial head covering for a human user.

BACKGROUND

Wearable hairpieces are commonly used for covering the head of a human user, for example, for cosmetic purposes (e.g., to cover a bald area of the head), decorative purposes (e.g., as part of a costume), or religious purposes (e.g., as a showing of modesty or devotion to a faith). A wearable hairpiece, which may also be referred to as a wig or toupee, can include natural or synthetic hair sewn in bulk onto a body implement that conforms around the top and sides of the user's head. The hair of the wearable hairpiece is generally intended to mimic the look of natural hair such that others might not detect its use.

SUMMARY

In an embodiment, a wearable hairpiece is provided for covering a first portion of a head of a human user. The wearable hairpiece comprises a band adapted to fit around the first portion of the head of the human user. The wearable hairpiece further comprises a plurality of hair wefts coupled to an outer surface of the band. Each hair weft of the plurality of hair wefts includes added hair covering at least some of the first portion. The band and the plurality of hair wefts do not cover natural hair of a second portion of the head of the human user when the band is on the head of the human user. The band is adapted for simultaneous use with a wearable accessory that covers the second portion.

In an embodiment, a wearable hairpiece is provided. The wearable hairpiece comprises a stretchable band adapted to fit around a head of a human user. The wearable hairpiece further comprises at least one hair weft coupled to the stretchable band. The at least one hair weft includes added hair covering a portion of the head of the human user when the stretchable band is around the head of the human user. The portion excludes a top of the head of the human user.

In an embodiment, a wearable hairpiece is provided for covering at least a portion of a head of a human user. The wearable component comprises a band, at least one hair weft, and at least one clip element. The band has a stretchable size and is comprised of a non-slip material. A front of the band is adapted to fit at a front hairline of the head of the human user and a back side of the band is adapted to fit across a back of the head of the human user. A nape piece is coupled to a lower portion of the back side of the band. The at least one hair weft is coupled to at least one of the back side of the band or the nape piece. The at least one hair weft comprises added hair. The added hair comprises double-drawn natural hair arranged in a U-shaped formation covering at least a portion of a left side, the back, and a right side of the head of the human user. The at least one clip element is coupled to the back side of the band. The at least one clip element adapted to prevent the band from moving when on the head of the human user.

These and other aspects of this disclosure are disclosed in the following detailed description, the appended claims, and the accompanying figures.

BRIEF DESCRIPTION OF THE DRAWINGS

The description herein makes reference to the accompanying drawings wherein like reference numerals refer to like parts throughout the several views.

DETAILED DESCRIPTION

A typical wearable hairpiece is designed to cover the entire area of a head of a human user, which area is naturally covered by hair, such as the top, sides, and back of the head. In some cases, added hair of the wearable hairpiece can be designed so as to include additional embellishments, such as bangs located in the front of the head of the human user, curls depending downwardly from a top-center area, or the like. By extending to all portions of the head of the human user that are covered by natural hair, thereby covering the natural hair of the user, a wearable hairpiece prevents others from being able to discern that the user is wearing it. However, because a typical wearable hairpiece covers so much of the head, the user is unable to wear accessories on his or her head, such as hats, caps, bandanas, or the like, without those accessories either causing discomfort for the user (e.g., because a wearable accessory cannot fit on top of the wearable hairpiece and the natural hair of the user without causing some of the hair of the wearable hairpiece or the natural hair of the user to bunch up underneath the wearable accessory) or resulting in an undesirable appearance (e.g., because the bunching up of the hair of the wearable hairpiece or the natural hair of the human user causes the wearable accessory to not rest flatly on top of the user's head).

Embodiments of this disclosure address problems such as those using a wearable hairpiece designed to partially cover a head of a human user. The wearable hairpiece is adapted for simultaneous use with a wearable accessory without causing discomfort or an undesirable appearance. Hair wefts including hair (which may be natural, synthetic, or the like, or a combination thereof) are disposed about the sides of a band that can be worn around the head of the user. The hair of the wearable hairpiece partially covers the head of the user, for example, the sides and back thereof. In this way, the top of the head of the user can remain uncovered by the wearable hairpiece, such that a wearable accessory can be worn on the head of the user along with the wearable hairpiece without the wearable accessory appearing to rest on top of the wearable hairpiece.

Figure 1:
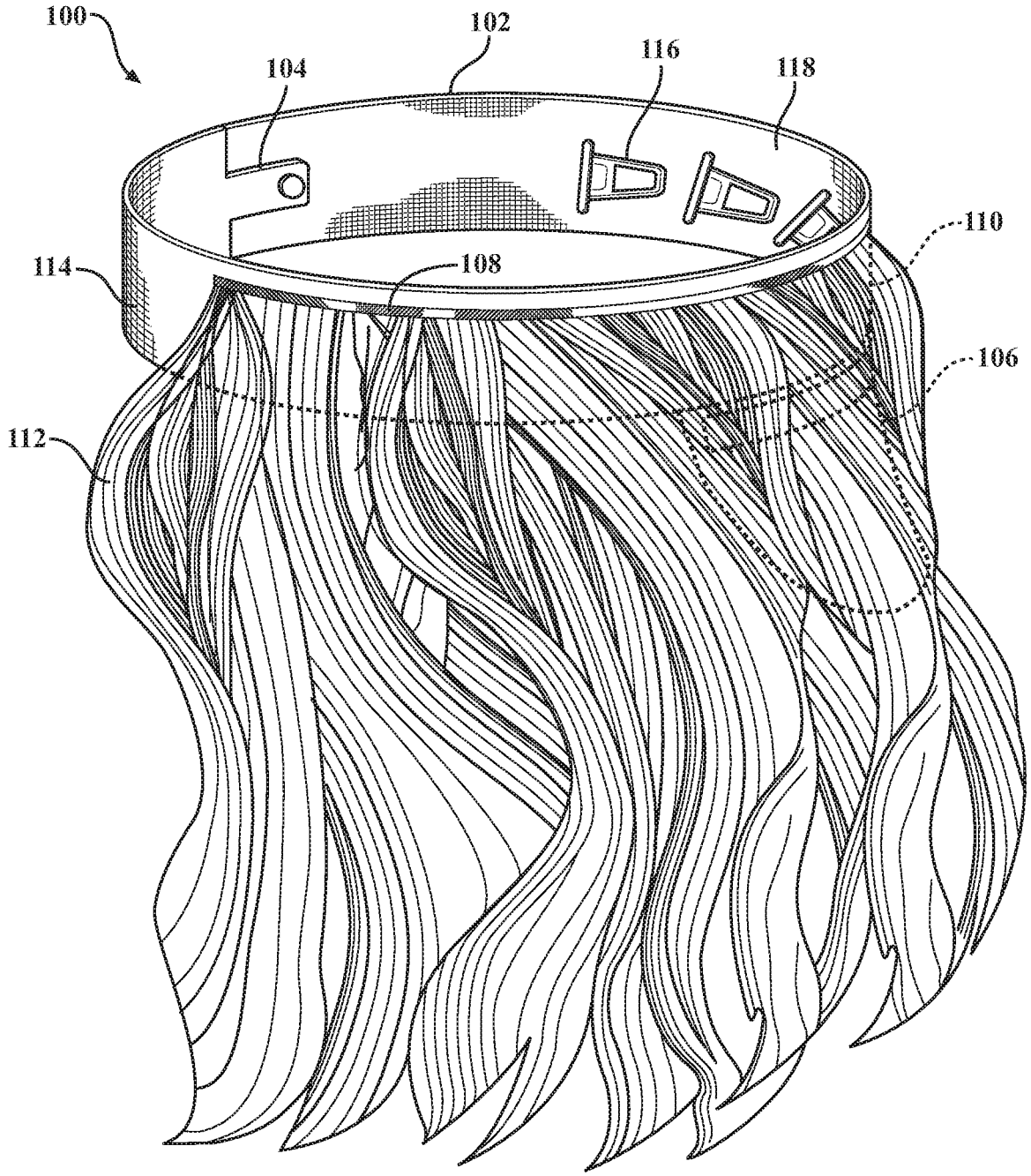
FIG. 1 is an illustration of an example of a wearable hairpiece.

FIG. 1 is an illustration of an example of a wearable hairpiece 100. The wearable hairpiece 100 is adapted to be worn on the head of a human user such that, when worn, the wearable hairpiece 100 covers a portion of the head. In particular, the wearable hairpiece 100, when worn, covers all or a portion of the natural hair of the human user on the sides and back of the head of the human user.

The wearable hairpiece 100 includes a band 102. The band is adapted to fit around the head of a human user. The band 102 is comprised of a material usable for coupling a wig or like object to a head of a human user. The band 102 may be comprised of a non-slip material for preventing the wearable hairpiece 100 from moving on the head of the human user while the wearable hairpiece 100 is in use. The band 102 has a stretchable size such that the band 102 can be expanded to fit heads of larger sizes.

The band 102 may include a locking mechanism 104 for reducing the size of the band 102, for example, for use with heads that are smaller than would otherwise be supported using a default setting of the band 102. For example, the locking mechanism 104 may include a hook and loop fastener (e.g., Velcro® brand), an adjustable elastic component, or the like. A button or like snapping element can be located on a first portion of the band 102 and a receiving element for receiving the snapping element can be located on a second portion of the band 102. The first portion can be stretched to a position of the second portion such that the button or like snapping element can be received by the receiving element. In another example, the locking mechanism 104 may include a tab and aperture configuration implemented using a tab on a first portion of the band 102, which tab is receivable within an aperture of a second portion of the band 102.

The wearable hairpiece 100 may include a nape piece 106. The nape piece 106 may be included as part of the band 102. Alternatively, the nape piece 106 may be a component separate from the band 102. The nape piece 106 is coupled to a lower portion of the band 102 and depends downwardly therefrom, for example, to cover a portion of the head of the human user below a bottom edge of the band 102. The nape piece 106 may also be adapted to cover a portion of the neck of the human user. The nape piece 106 may be comprised of the same material as of which the band 102 is comprised. Alternatively, the nape piece 106 may be comprised of a different material as of which the band 102 is comprised. Although the nape piece 106 is shown in FIG. 1 as having a half-circle shape, the nape piece 106 can have other shapes for covering the aforesaid portions of the human user.

One or more hair wefts 108 are coupled to the band 102. Alternatively, the one or more hair wefts (or certain ones of the one or more hair wefts) may be coupled to the nape piece 106. A hair weft 108 can include a coupling element 110 and added hair 112 coupled to the coupling element 110. The coupling element 110 can be a strip of fabric, cloth, a string, or another element to which the added hair 112 can be sewn. For example, the coupling element 110 may be velour. The added hair 112 may be sewn onto the velour using one or more stitch lines.

The added hair 112 may be removably coupled to the coupling element 110, for example, using a locking mechanism (not shown) that may be similar to the locking mechanism 104 of the band 102. Where the added hair 112 is so removable, a user may replace the added hair 112 with different added hair, for example, to customize the wearable hairpiece 100 according to various hair styles, colors, or the like. The added hair 112 can be natural hair (e.g., collected from hair donors, for example, human hair donors), synthetic hair (e.g., comprised of a cotton, nylon, polymer, or like material or combination of materials), or the like or a combination thereof. The added hair 112 can be formed using one or more techniques. For example, the added hair 112 may be double-drawn or non-double-drawn.

The one or more hair wefts 108 can be sewn around all or a portion of an outer surface 114 of the band 102 and/or an outer surface of the nape piece 106. Separately, one or more clip elements 116 can be disposed within all or a portion of an inner surface 118 of the band 102. The one or more clip elements 116, when used, can secure the band 102 to the natural hair of the user. The one or more hair wefts 108 support a flat level formation of the added hair 112 of the wearable hairpiece 100.

Embodiments other than those shown and described with respect to FIG. 1 may be provided. In some embodiments, one or more adjustment elements (not shown) can also be included on the outer surface 114 of the band 102 or the inner surface 118 of the band 102. The one or more adjustment elements can be adapted for adjusting a length of the added hair 112. For example, an adjustment element can include a mechanism for retaining a portion of the added hair 112 of a hair weft 108 that can be pulled to cover more of the natural hair, head, neck, or like aspect of the human user.

Figure 2:
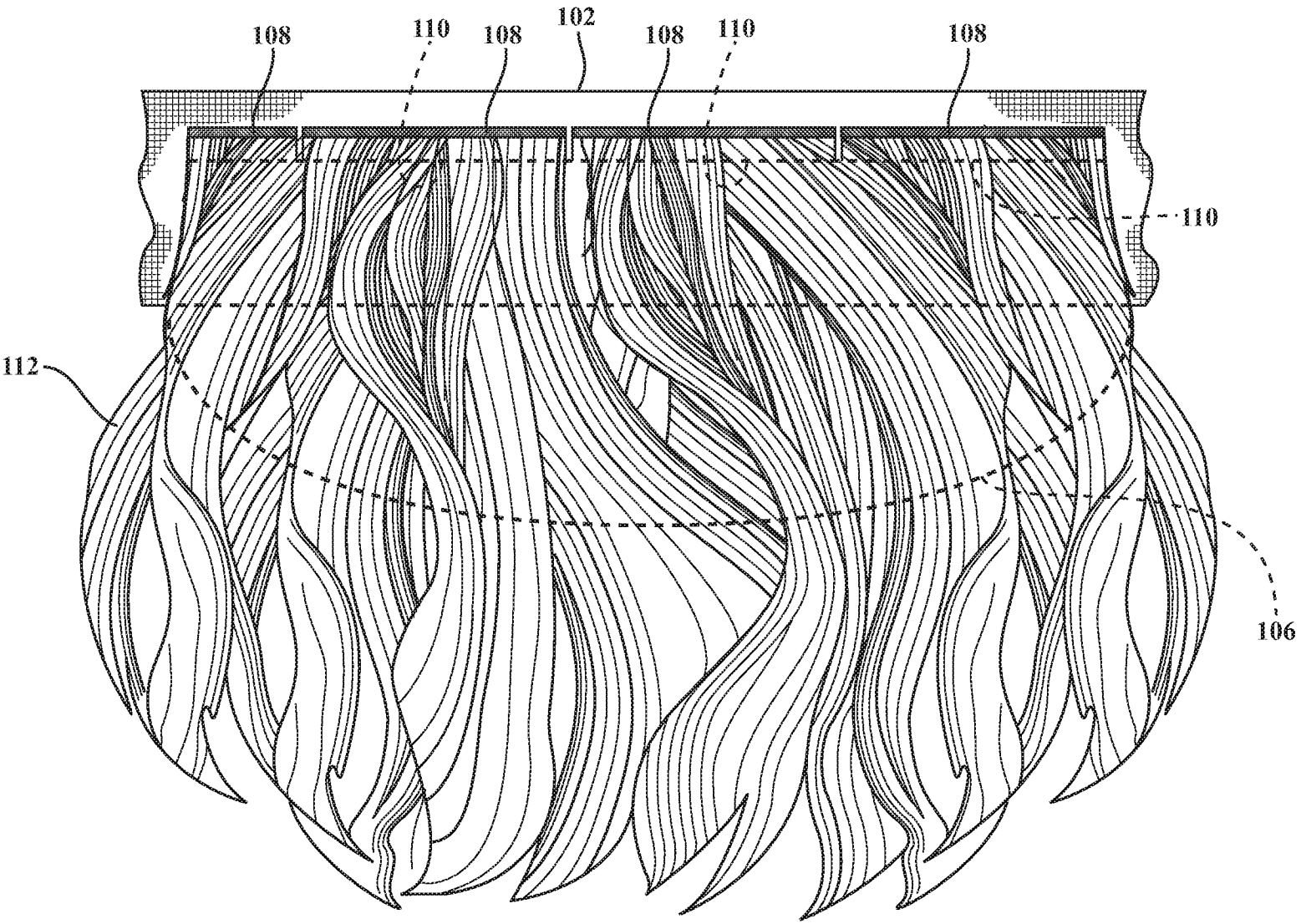
FIG. 2 is an illustration of an example of a hair weft coupled to a band of a wearable hairpiece.

FIG. 2 is an illustration of an example of a hair weft 108 coupled to a band 102 of a wearable hairpiece. As described above, the hair weft 108 can include a coupling element 110, wherein added hair 112 can be sewn to the coupling element 110 to secure the added hair 112 to the hair weft 108. The coupling element 110 may also or instead be used to secure the hair weft 108 to the band 102 or the nape piece 106 of the wearable hairpiece. As shown in FIG. 2, multiple hair wefts 108 can be coupled to the band 102 and/or the nape piece 106 of the wearable hairpiece. In such a case, multiple coupling elements 110 can attach (e.g., via permanent or removable coupling) various sets of added hair 112 to different portions of the band 102 and/or the nape piece 106. In this way, all or a portion of an outer surface of the band can be covered by the added hair 112. As shown in FIG. 2, when the wearable hairpiece 100 is not in use on a head of a human user, the added hair 112 may be arranged in a straight, flat formation.

Embodiments other than those shown and described with respect to FIG. 2 may be provided. In some embodiments, a single hair weft 108 adapted to cover all or a portion of the outer surface of the band 102 and the outer surface the nape piece 106 can be used. In some embodiments, a first hair weft 108 adapted to cover all or a portion of the outer surface of the band 102 can be used along with a second hair weft 108 adapted to cover all or a portion of the outer surface of the nape piece 106.

Figure 3:
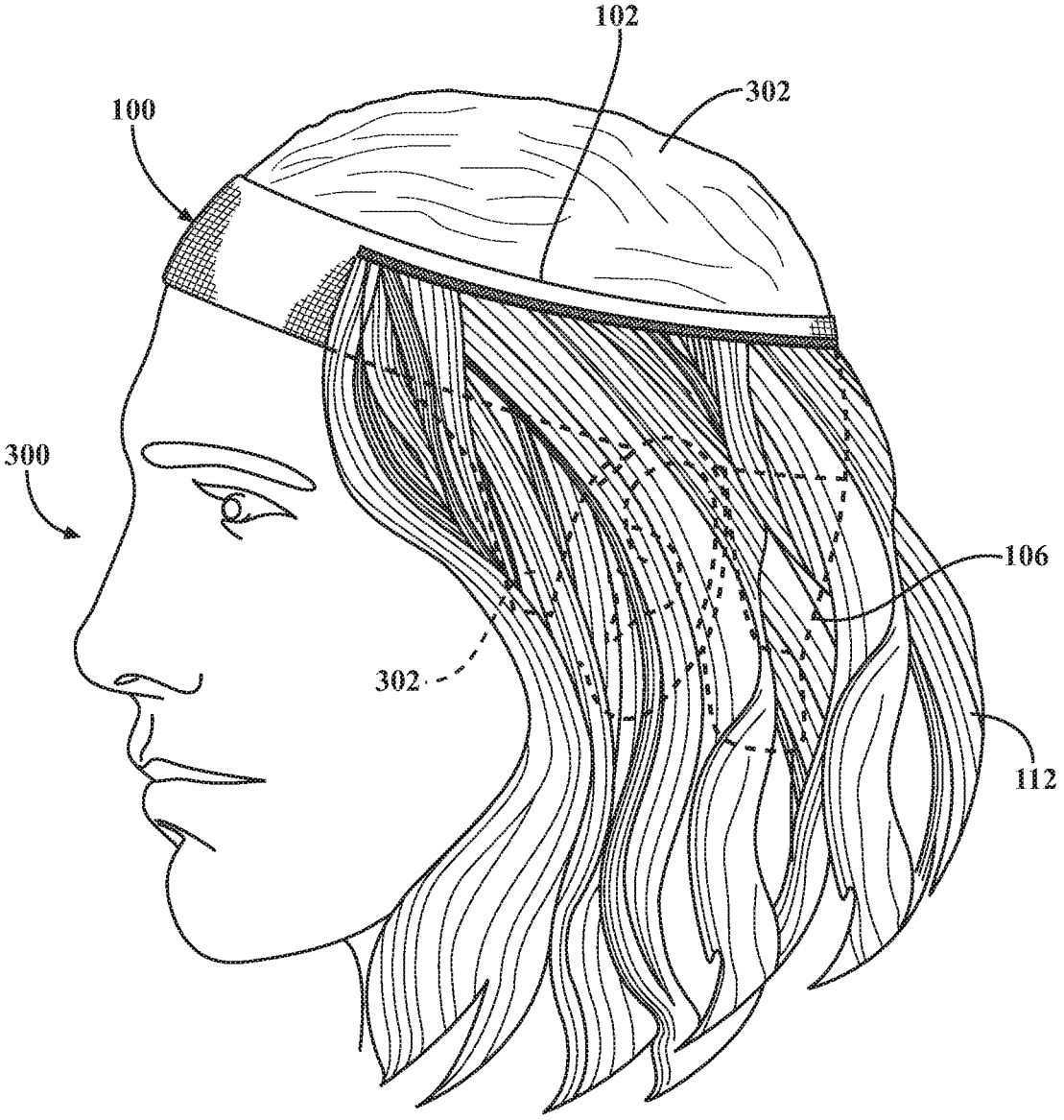
FIG. 3 is an illustration of an example of a wearable hairpiece in use on a head of a human user.

FIG. 3 is an illustration of an example of a wearable hairpiece 100 in use on a head 300 of a human user. The band 102 of the wearable hairpiece 100 is adapted to fit around the head 300 of the human user. In particular, the added hair 112 coupled to the band 102 (and the nape piece 106) of the wearable hairpiece 100 is adapted to cover a portion of the natural hair 302 of the head 300 of the human user. For example, the added hair 112 can depend downwardly from the band 102 and the nape piece 106 such that the added hair 112 covers the sides and back of the head 300 of the human user, but not the top of the head 300 of the human user. In this way, the natural hair 302 at the top of the head 300 of the human user remains visible while the wearable hairpiece 100 is in use.

The hair wefts used to provide the added hair 112 support a flat level formation of the added hair 112 allowing the added hair 112 to flatly rest on the head 300 of the human user. The natural hair 302 of the human user can be pulled through the top of the wearable hairpiece 100 (e.g., above an upper surface of the band 102) such that the natural hair 302 remains in place on top of the head 300 of the human user. As shown in FIG. 3, when the wearable hairpiece 100 is in use on the head 300 of the human user, the added hair 112 may be arranged in a U-shaped formation. For example, the U-shaped formation can reflect that, when the wearable hairpiece 100 is in use on the head 300 of the human user, the added hair 112 may cover at least a portion of a left side, the back, and a right side of the head 300 of the human user.

Figure 4:
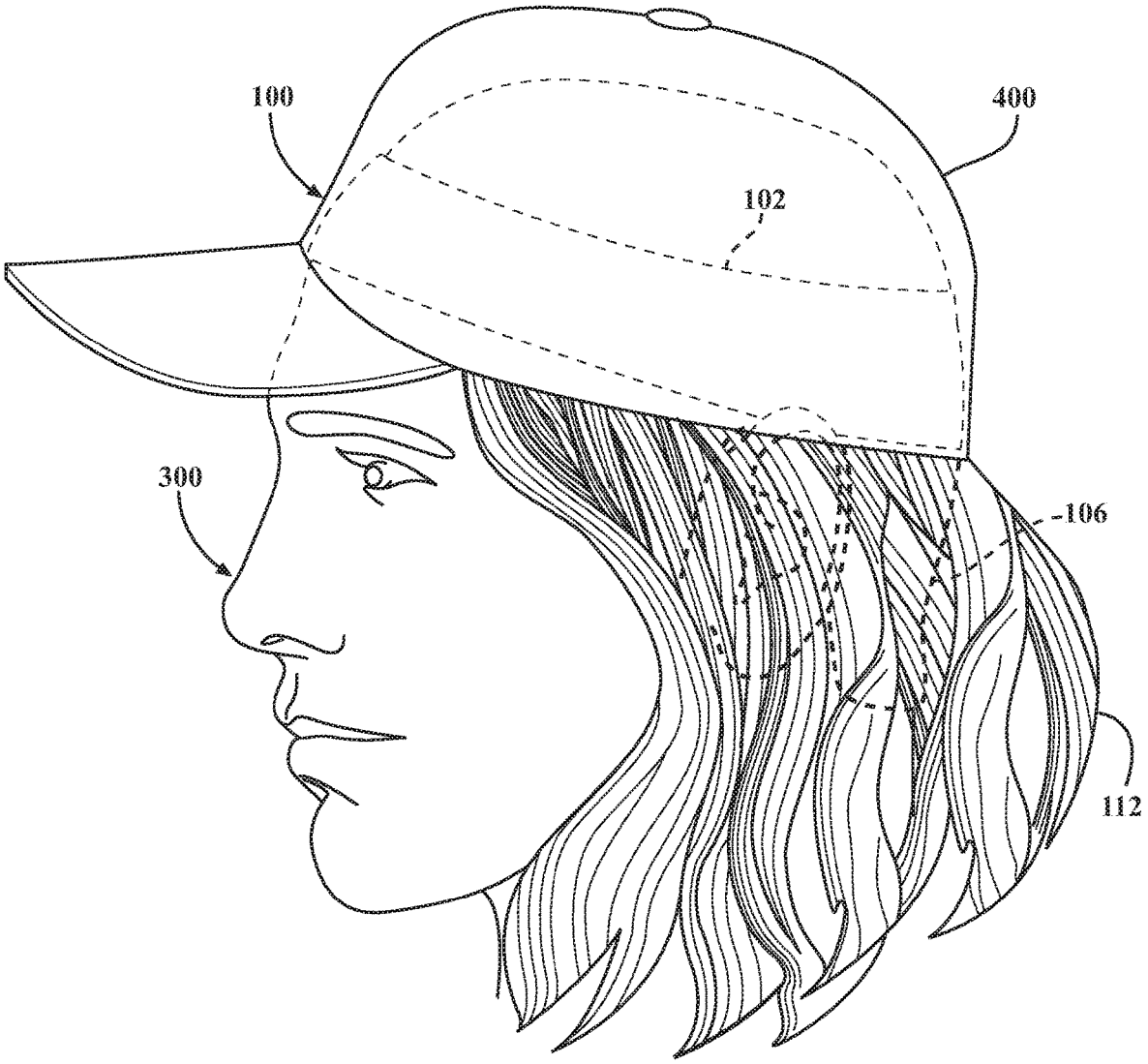
FIG. 4 is an illustration of an example of a wearable hairpiece in simultaneous use with a wearable accessory on a head of a human user.

FIG. 4 is an illustration of an example of a wearable hairpiece 100 in simultaneous use with a wearable accessory 400 on a head 300 of a human user. The wearable accessory 400 is shown in FIG. 4 as a hat; however, the wearable accessory 400 can be other accessories wearable on the head 300 of the human user, such as a cap, baseball-style hat, bandana, beanie, fedora, or other wearable accessory. As shown in FIG. 4, the wearable accessory 400 can fit on top of the head 300 of the human user, and, more particularly, on top of the wearable hairpiece 100, without appearing to rest on top of the added hair 112. Instead, and by virtue of the band 102 not coupling the added hair 112 on top of the head 300 of the human user, the wearable accessory 400 may be worn on the head 300 of the human user at a location that is wholly or partially uncovered by the wearable hairpiece 100. Where the band 102 of the wearable hairpiece 100 is not entirely covered by the added hair 112, the band 102 can be covered by a portion of the wearable accessory 400 such that it remains hidden from view.

The wearable accessory 400 can be removed and replaced on the head of the human user 300 without disturbing the use or operation of the wearable hairpiece 100. For example, the human user 300 can remove the wearable accessory 400 to observe a condition of the wearable hairpiece 100 or his or her own natural hair (e.g., on top of his or her head) as desired and can then put the wearable accessory 400 back on his or her head when finished. The wearable accessory 400 can also be switched with other wearable accessories as desired, for example, if the human user 300 wants to use a different hat, cap, or the like in concert with the wearable hairpiece 100.

The use of the terms "including," "comprising," "having," or variations thereof herein is meant to encompass the items listed thereafter and equivalents thereof as well as additional items. Unless specified or limited otherwise, the terms "mounted," "connected," "supported," "coupled," or variations thereof are used broadly and encompass both direct and indirect mountings, connections, supports, and couplings. Further, "connected" and "coupled" are not restricted to physical or mechanical connections or couplings.

The use of the terms "a," "an," "the," or similar referents in the context of describing the embodiments of this disclosure (especially in the context of the following claims) should be construed to cover both the singular and the plural. Furthermore, unless otherwise indicated herein, the recitation of ranges of values herein is merely intended to serve as a shorthand alternative to referring individually to respective separate values falling within the range, and respective separate values are incorporated into the specification as if individually recited herein. Finally, the operations of any methods, techniques, algorithms, or instructions described herein are performable in any suitable order unless clearly indicated otherwise by the context. The use of an example, or language suggesting that an example is being described (e.g., "such as"), provided herein is intended merely to better illuminate the embodiments of this disclosure and does not pose a limitation on the scope of this disclosure unless otherwise claimed.

All references, including publications, patent applications, and patents, cited herein are hereby incorporated by reference to the same extent as if the references were individually and specifically indicated as incorporated by reference and were set forth in its entirety herein.

The above-described embodiments have been described in order to facilitate easy understanding of this disclosure, and such descriptions of such embodiments do not limit this disclosure. To the contrary, the embodiments of this disclosure are intended to cover various modifications and equivalent arrangements included within the scope of the appended claims, which scope is to be accorded the broadest interpretation as is permitted by law so as to encompass such modifications and equivalent arrangements.

What is claimed is:

1. A wearable hairpiece for covering a first portion of a head of a human user, the wearable hairpiece comprising:

a band adapted to fit around the first portion of the head of the human user;

a nape piece disposed at a lower portion of an outer surface of the band; and a plurality of hair wefts including one or more first hair wefts coupled to the outer surface of the band and one or more second hair wefts coupled to the nape piece, each hair weft of the plurality of hair wefts including added hair adapted to cover at least some of the first portion, wherein the band and the plurality of hair wefts do not cover natural hair of a second portion of the head of the human user when the band is on the head of the human user, and wherein the band is adapted for simultaneous use with a wearable accessory that covers the second portion.

2. The wearable hairpiece of claim 1, wherein the plurality of hair wefts supports a flat level formation of the added hair.

3. The wearable hairpiece of claim 1, wherein the band has a stretchable size and is comprised of a non-slip material.

4. The wearable hairpiece of claim 1, wherein the plurality of hair wefts includes a coupling element, wherein the one or more first hair wefts are coupled to the band using the coupling element.

5. The wearable hairpiece of claim 4, further comprising:

a locking mechanism adapted to removably couple the added hair of the one or more first hair wefts to the coupling element.

6. The wearable hairpiece of claim 1, further comprising:

at least one clip element coupled to an inner surface of the band, the at least one clip element preventing the band from moving on the head of the human user when the band is on the head of the human user.

7. The wearable hairpiece of claim 1, wherein the added hair comprises double-drawn natural hair.

8. The wearable hairpiece of claim 1, wherein the band includes an adjustment element adapted for adjusting a length of the added hair.

9. A wearable hairpiece, comprising:

a stretchable band adapted to fit around a head of a human user;

a nape piece disposed at a lower portion of the stretchable band; and at least two hair wefts, the at least two hair wefts including added hair adapted to cover a portion of the head of the human user when the stretchable band is around the head of the human user, the portion excluding a top of the head of the human user, wherein the at least two hair wefts include one or more first hair wefts coupled to the stretchable band and one or more second hair wefts coupled to the nape piece.

10. The wearable hairpiece of claim 9, wherein the at least two hair wefts include a coupling element, wherein the one or more first hair wefts are coupled to the stretchable band using the coupling element.

11. The wearable hairpiece of claim 10, further comprising:

a locking mechanism adapted to removably couple the added hair of the one or more first hair wefts to the coupling element.

12. The wearable hairpiece of claim 9, further comprising:

at least one clip element coupled to the stretchable band, the at least one clip element preventing the stretchable band from moving when the stretchable band is around the head of the human user.

13. The wearable hairpiece of claim 9, wherein the stretchable band is comprised of a non-slip material.

14. The wearable hairpiece of claim 9, wherein the added hair comprises double-drawn natural hair.

15. The wearable hairpiece of claim 9, wherein a top edge of the stretchable band is adapted to be below the top of the head of the human user.

16. The wearable hairpiece of claim 9, wherein the stretchable band is adapted for simultaneous use with a wearable accessory without causing the wearable accessory to rest on top of the added hair.

17. A wearable hairpiece for covering at least a portion of a head of a human user, the wearable hairpiece comprising:

a band having a stretchable size and comprised of a non-slip material, wherein a front of the band is adapted to fit at a front hairline of the head of the human user and a back side of the band is adapted to fit across a back of the head of the human user, wherein a nape piece is coupled to a lower portion of the back side of the band;

at least one hair weft coupled to at least one of the back side of the band or the nape piece, the at least one hair weft comprising added hair, the added hair comprising double-drawn natural hair arranged in a U-shaped formation adapted to cover at least a portion of a left side, the back, and a right side of the head of the human user; and at least one clip element coupled to the back side of the band, the at least one clip element adapted to prevent the band from moving when on the head of the human user.

18. The wearable hairpiece of claim 17, wherein the band and the at least one hair weft do not cover natural hair on a top of the head of the human user when the band is on the head of the human user, wherein the at least one hair weft supports a flat level formation of the added hair, wherein the band is adapted for simultaneous use with a wearable accessory that covers the top of the head of the human user without the wearable accessory appearing to rest on top of the added hair.

* * * * *